US008450659B2

(12) United States Patent
Theodos et al.

(10) Patent No.: US 8,450,659 B2
(45) Date of Patent: May 28, 2013

(54) CONTROL SYSTEM AND METHOD FOR HIGH DENSITY UNIVERSAL HOLDING CABINET

(75) Inventors: Michael Andrew Theodos, Bossier City, LA (US); Steven Matthew Takata, Minneapolis, MN (US); Charles D. Grant, Shreveport, LA (US)

(73) Assignee: Restaurant Technology, Inc., Oak Brook, IL (US)

( * ) Notice: Subject to any disclaimer, the term of this patent is extended or adjusted under 35 U.S.C. 154(b) by 366 days.

(21) Appl. No.: 12/761,919

(22) Filed: Apr. 16, 2010

(65) Prior Publication Data

US 2011/0253703 A1 Oct. 20, 2011

(51) Int. Cl.
*H05B 1/02* (2006.01)

(52) U.S. Cl.
USPC ..... 219/510; 219/509; 219/508; 219/507; 219/395; 219/391

(58) Field of Classification Search
USPC ..... 219/510, 509, 508, 507, 395, 391, 219/385
See application file for complete search history.

(56) References Cited

U.S. PATENT DOCUMENTS

| | | | | |
|---|---|---|---|---|
| 4,446,780 | A | 5/1984 | Puvogel et al. | 99/480 |
| 4,446,811 | A | 5/1984 | Howie, Jr. | 116/309 |
| 4,605,840 | A | 8/1986 | Koopman | 219/401 |
| D335,732 | S | 5/1993 | King | D34/21 |
| 5,771,959 | A | 6/1998 | Westbrooks, Jr. et al. | 165/48.1 |
| 5,783,803 | A | 7/1998 | Robards, Jr. | 219/392 |
| 5,880,434 | A | 3/1999 | Pinnow et al. | 219/386 |
| 5,900,173 | A | 5/1999 | Robards, Jr. | 219/392 |
| 6,011,243 | A | 1/2000 | Arnold et al. | 219/506 |
| 6,658,994 | B1 | 12/2003 | McMillan | 99/468 |
| 6,753,511 | B2 * | 6/2004 | Mathews et al. | 219/492 |
| 7,105,779 | B2 | 9/2006 | Shei | 219/413 |
| 7,132,926 | B2 | 11/2006 | Vaseloff et al. | 340/5.92 |
| 7,258,064 | B2 | 8/2007 | Vaseloff et al. | 99/468 |
| 7,446,282 | B2 | 11/2008 | Shei et al. | 219/391 |
| 7,628,107 | B2 | 12/2009 | Vaseloff et al. | 99/468 |
| 2003/0047553 | A1 * | 3/2003 | Patti et al. | 219/400 |
| 2004/0020915 | A1 | 2/2004 | Shei | 219/385 |
| 2004/0069155 | A1 | 4/2004 | Shei | 99/448 |
| 2004/0139863 | A1 | 7/2004 | Boryca et al. | 219/385 |
| 2005/0211775 | A1 | 9/2005 | Vaseloff et al. | 235/385 |
| 2005/0255208 | A1 | 11/2005 | Shei | 426/523 |

(Continued)

OTHER PUBLICATIONS

International Search Report and Written Opinion mailed May 31, 2011 in corresponding PCT/US2011/029488.
International Search Report and Written Opinion mailed Jun. 3, 2011 in related PCT/US2011/029487.

(Continued)

*Primary Examiner* — Vu Le
*Assistant Examiner* — Han Yang
(74) *Attorney, Agent, or Firm* — Ryndak & Suri LLP

(57) ABSTRACT

A load control system and method of time multiplexing power to a plurality of holding shelves in a food holding cabinet to allow total cabinet power to be limited to electrical distribution capabilities. This method allows for individual shelf heaters to be utilized normally to maintain food temperatures during normal use and modulates power when multiple shelves demand heating that would normally exceed branch circuit capabilities thus tripping the breaker. The system monitors temperature of each shelf and based upon demand executes a logical demand schedule for each shelf heater output (time multiplexing or modulating AC power to each) such that total system demand does not exceed available power to the system.

20 Claims, 9 Drawing Sheets

U.S. PATENT DOCUMENTS

| | | | | |
|---|---|---|---|---|
| 2006/0185527 | A1 | 8/2006 | Shei | 99/468 |
| 2007/0144202 | A1 | 6/2007 | Theodos et al. | 62/348 |
| 2008/0023462 | A1 | 1/2008 | Shei et al. | 219/394 |
| 2008/0213449 | A1 | 9/2008 | Wisner et al. | 99/374 |
| 2009/0064874 | A1 | 3/2009 | Chew | 99/473 |

OTHER PUBLICATIONS

International Preliminary Report on Patentability dated Aug. 3, 2012 for corresponding International Patent Application No. PCT/US2011/029487.

* cited by examiner

CONTROL SYSTEM AND METHOD FOR HIGH DENSITY UNIVERSAL HOLDING CABINET

RELATED APPLICATION

This application is related to U.S. patent application Ser. No. 12/761,820 of Michael Andrew Theodos, Joshua Michael Cox, and Marie Antoinette Ketterman, which is assigned to the assignee of this application and is filed on the same date as this application.

FIELD OF THE DISCLOSURE

This disclosure relates to a control system that controls the application of power to a plurality of loads in a food service system. In particular, the disclosure relates to a food holding cabinet system in which the loads are electrical heaters.

BACKGROUND OF THE DISCLOSURE

Food holding cabinets are used to maintain optimal cooked food product temperatures until the food product is served. Individual trays are loaded into shelf-like row assemblies within the cabinet with heating plates. Cooks within a restaurant typically cook food in small batches likely beyond the immediate need of the product. This excess food is placed in a tray within a holding cabinet shelf that is used to maintain the temperature of that food product until served. Various food products are typically cooked at different times (perhaps staggered in time). Thus, normal operational load is that of normal holding of already loaded food product as well as newly loaded food product creating additional periodic load. The wattage of the heaters is sized to properly maintain food quality and temperature.

To better understand the problem, well over 100,000 holding cabinets exist in the field. Over time, the restaurants that use these holding cabinets have become densely populated with more equipment and at the same time, have increased their menu choices. Both of these drivers have created a need to provide more food storage within the existing holding cabinet space. Adding additional row assemblies or cabinet slots to existing holding cabinets increases the number of heaters. Depending on the number of cabinet slots, it is possible that the plurality of heater demands could exceed the branch circuit limitations to the cabinet (for example, at morning cabinet start up and unusually high load times) thereby tripping the circuit breaker.

Thus, there is a need for limiting total cabinet power consumption to electrical power distribution capabilities.

SUMMARY OF THE DISCLOSURE

A control system of the present disclosure controls current flow in a plurality of loads of a food service system. The control system comprises a like plurality of switches and a controller. The controller operates the switches to connect the plurality of loads to a power source during a high demand time such that the total power consumption of the loads is limited to a rated power level or below of the power source during at least a portion of said high demand time.

In another embodiment of the present disclosure, the controller controls on times of the switches at a duty cycle in which only X of the total number of the switches are turned on at the same time, where X is greater than two and wherein the duty cycle is less than 100 percent.

In another embodiment of the present disclosure, the total number of switches is twelve, X is eight, and the duty cycle is 66.67%.

In another embodiment of the present disclosure, the switches and the loads are connected in a feedback system, and wherein the on times are determined by feedback of at least one parameter of the loads.

In another embodiment of the present disclosure, the on times are based on a difference between a current value of the parameter and a reference value of the parameter.

In another embodiment of the present disclosure, the parameter is a temperature.

In another embodiment of the present disclosure, the food service system is a food holding cabinet and the loads are heaters.

In another embodiment of the present disclosure, the controller further comprises a processor that executes a heater multiplexing program and uses a heater mask to provide signals that operate the switches.

In another embodiment of the present disclosure, if less than X heaters are requesting on time, the processor ignores the heater mask and operates the switches such that the duty cycle for each of the heaters is 100%.

In another embodiment of the present disclosure, if the difference is within a range of a predetermined temperature and the reference temperature, the controller enters a tight regulation mode in which the switches are operated at the duty cycle of less than 100%.

A method of the present disclosure controls current flow in a plurality of loads in a food service system. The method comprises: controlling a like plurality of switches to connect the plurality of loads to a power source during a high demand time such that the total power consumption of the loads is limited to a rated power level or below of the power source during at least a portion of said high demand time.

In another embodiment of the method of the present disclosure, the controlling step controls on times of the switches at a duty cycle in which only X of the total number of the switches are turned on at the same time, where X is greater than two and wherein the duty cycle is less than 100 percent.

In another embodiment of the method of the present disclosure, the total number of switches is twelve, X is eight, and the duty cycle is 66.67%.

In another embodiment of the method of the present disclosure, the switches and the loads are connected in a feedback system, and wherein the on times are determined by feedback of at least one parameter of the loads.

In another embodiment of the method of the present disclosure, the on times are based on a difference between a current value of the parameter and a reference value of the parameter.

In another embodiment of the method of the present disclosure, the parameter is a temperature.

In another embodiment of the method of the present disclosure, the food service system is a food holding cabinet and the loads are heaters.

In another embodiment of the method of the present disclosure, the controlling step comprises a processor that executes a heater multiplexing program and uses a heater mask to provide signals that operate the switches.

In another embodiment of the method of the present disclosure, if less than X heaters are requesting on time, the processor ignores the heater mask and operates the switches such that the duty cycle for each of the heaters is 100%.

In another embodiment of the method of the present disclosure, if the difference is within a range of a predetermined temperature and the reference temperature, the controller enters a tight regulation mode in which the switches are operated at the duty cycle of less than 100%.

In order to avoid excess load during peak demand loads, modulation of the individual heaters with thyristor based switches as well as unique modulation algorithms are used to time multiplex load to each shelf such that maximum power draw from the restaurant branch circuit is limited to rated levels. In addition, during periods of non-peak demand, full shelf power is available to maximize recovery due to heavy loading and maintain tighter control of the food product being stored.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

Figure 1:
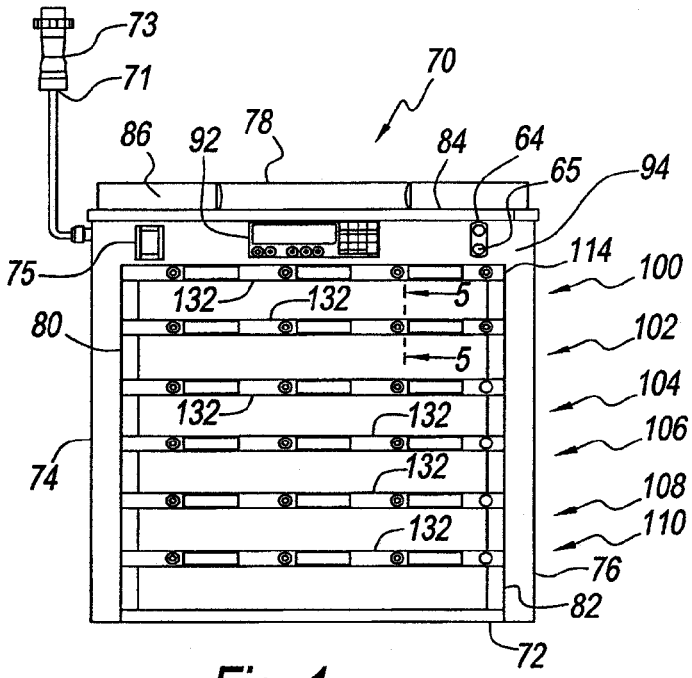
FIG. 1 is a front view of a food holding cabinet of the present disclosure.

It is contemplated that the heater control system of the present disclosure can be used in any food service equipment for distribution of power to multiple loads. However, by way of example and completeness of description, the heater control system will be described herein for a food holding cabinet.

Referring to FIGS. 1-4, a food holding cabinet 70 of the present disclosure comprises a base 72, a first outer side panel 74, a second outer side panel 76 and an outer top panel 78. A first inner side panel 80 and a second inner side panel 82 are spaced from first outer side panel 74 and second outer side panel 76 by gaps 88 and 90, respectively (shown in FIG. 2). Outer top panel 78 is spaced from an inner top panel 84 by a gap 86. A user interface 92, a time query button 64 and a temperature query button 65 are disposed on a front panel 94 (shown in FIG. 1).

Figure 5:
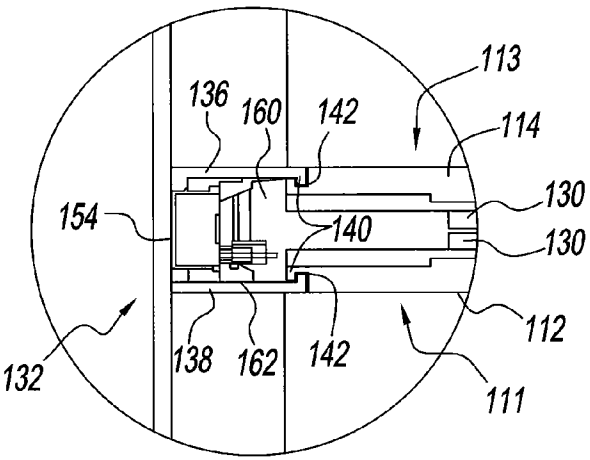
FIG. 5 is a cross-sectional view taken along line 5 of FIG. 1.

Referring also to FIG. 5, a plurality of row assemblies 100, 102, 104, 106, 108 and 110 are supported by first inner side panel 80 and second inner side panel 82. Each row assembly, e.g., row assembly 102, comprises an upper heater assembly 111 and a lower heater assembly 113 (shown in FIG. 5). Upper heater assembly 111 and lower heater assembly 113 each comprises an upper heater plate 112 and a lower heater plate 114, respectively. Upper heater plate 112 and lower heater plate 114 are supported by a pair of spacer side rails 116 and 118 (shown in FIGS. 3 and 4).

Figure 2:
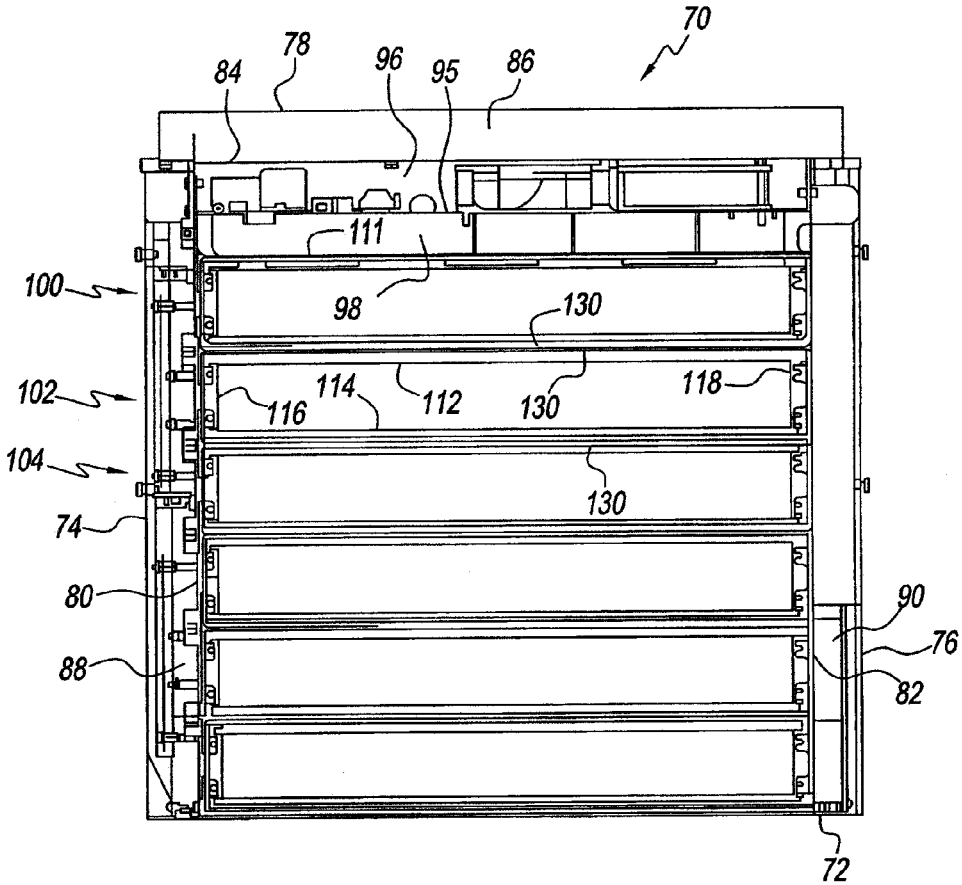
FIG. 2 is a front view of the food holding cabinet of FIG. 1 with bezels and front panel removed.
Figure 4:
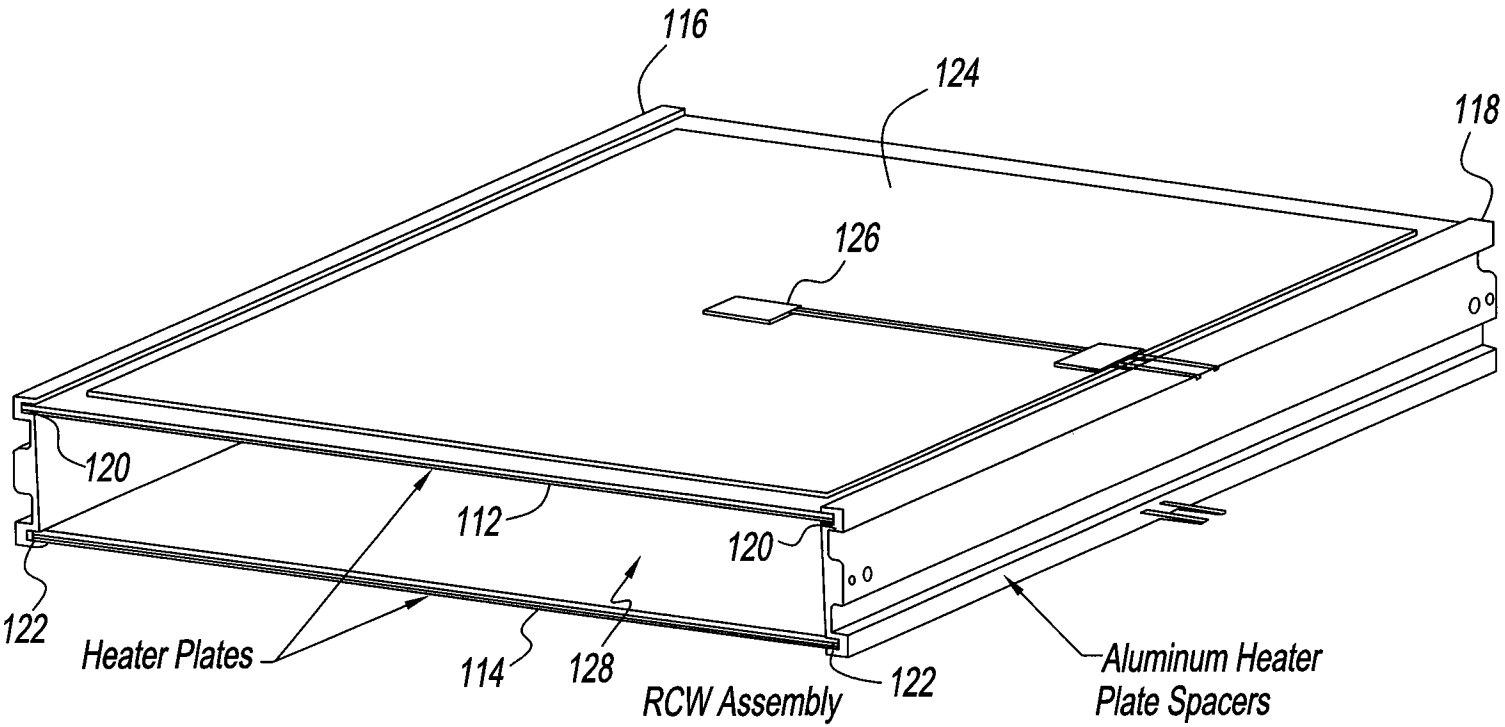
FIG. 4 is a perspective view of the row assembly of FIG. 3 with bezels removed.

Spacer side rails 116 and 118 are attached to upper heater plate 112 by any suitable fastener, for example set screws 302 (shown in FIG. 3) and to lower heater plate 114 by similar set screws (not shown). Spacer side rails 116 and 118 are also attached to first and second inner side panels 80 and 82 by screws (not shown) in top and bottom of spacer side rails 116 and 118. Spacer side rails 116 and 118 each include an upper slot 120 and a lower slot 122 that extend from front to back. Opposite side edges of upper heating plate 112 fit into upper slots 120 of spacer side rails 116 and 118 (shown in FIG. 4). Opposite side edges of lower heating plate 114 fit into lower slots 122 of spacer side rails 116 and 118 (shown in FIG. 4). As shown in FIG. 2, inner top panel 84 is spaced by a gap 96 from a panel 95, which is spaced by a gap 98 from upper heater assembly 111 in row 100.

Referring to FIG. 5, upper heater assembly 111 further comprises, e.g., a vulcanized heater 124, although other types of heaters may be used. Vulcanized heater 124, for example, may be obtained from Watlow Company. Heater 124 is disposed on the upper surface of heater plate 112 and carries a temperature sensor 126. Temperature sensor 126 may be any suitable temperature sensor and, preferably, may be a Resistor Temperature Device (RTD), also available from Watlow Company.

Lower heater assembly 113 further comprises a similar vulcanized heater (not shown) that is disposed on the lower surface of lower heater plate 114 and that carries a temperature sensor (not shown). Upper and lower slots 120 and 122 are spaced to provide a gap or cavity 128 to permit the insertion of a food tray. Upper and lower heater plates 112 and 114 may be any suitable material that transfers heat from the vulcanized heaters 124 to cavity 128. For example, upper and lower heater plates 112 and 114 may be formed of a metal, for example, aluminum, stainless steel, or other metals.

A thermal insulation layer 130 is wrapped around row assembly 102 and spacer side rails 116 and 118. Insulation layer 130 lowers any heat transfer from upper heater plate 112 of row assembly 102 to row assembly 100 and from lower heater plate 114 of row assembly 102 to row assembly 104. A similar insulation layer 130 of row assemblies 100 and 104 further limits heat transfer from adjacent row assemblies 100 and 104 to row assembly 102. Row assemblies 106, 108 and 110 are similarly wrapped with an insulation layer 130 to limit heat transfer to and from adjacent row assemblies.

Referring to FIGS. 1, 3, 5 and 6, a bezel 132 and a bezel 133 are provided for each row assembly. Bezel 132 for row assembly 102 covers a front edge of upper heater plate 112 of row assembly 102 and a front edge of lower heater plate 114 of row assembly 100 as shown in FIG. 5. Bezel 132 for row assembly 104 covers a front edge of upper heater plate 112 of row assembly 104 and a front edge of lower heater plate 114 of row assembly 102 and so on for row assemblies 106, 108 and 110. Bezel 132 for row assembly 100 covers only a front edge of the upper heater assembly 112 of row assembly 100 as row assembly 100 is the topmost row assembly. Bezel 133 covers a back edge of upper heater plate 112 of row assembly 102 and, though not shown in the drawing, covers a front edge of lower heater plate 114 of row assembly 100. Bezel 133 is otherwise identical to bezel 132. A bezel 133 is similarly provided for each of the other row assemblies. Bezels 132 and 133 are attached to inner side panels 80 and 82 and to the row assemblies by a suitable fastener (not shown).

Figure 6:
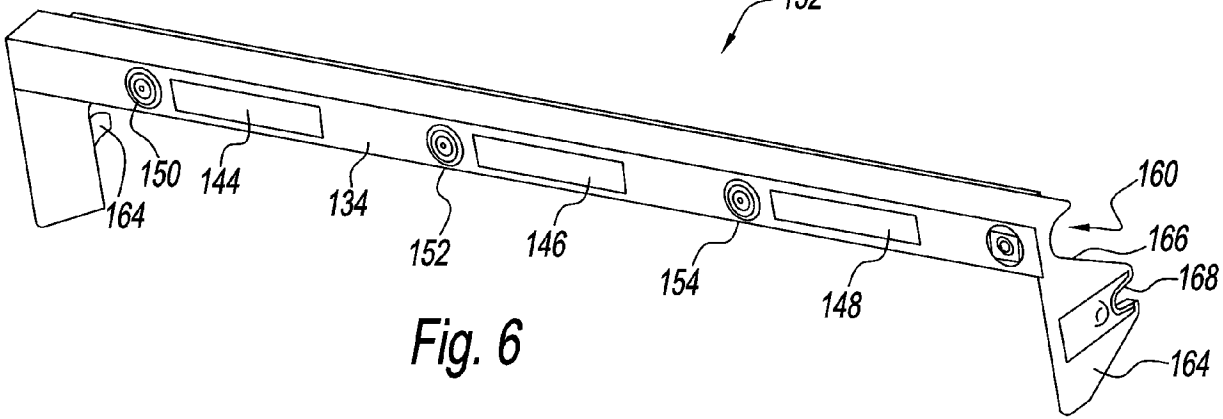
FIG. 6 is a front perspective view of a bezel of the food holding cabinet of FIG. 1.

Referring to FIGS. 5 and 6, bezel 132 comprises an elongated C-shaped body that has a display face 134 (shown in FIG. 6) and a pair of legs 136 and 138. Legs 136 and 138 have one or more portions or hooks 140 at their respective terminal ends. Legs 136 and 138 and hooks 140 are dimensioned so that hooks 140 fit snugly into mating portions or slots 142 of lower heater plate 114 of row assembly 100 and upper heater plate 112 of row assembly 102 with a snap-in action. This provides an interlock that minimizes unsealed interfaces or provides a seal to heater plates 112 and 114, thereby mitigating oil and/or grease migration.

Figure 3:
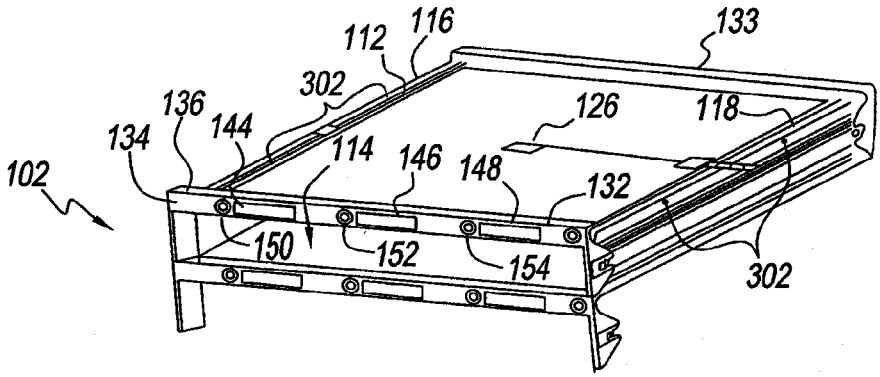
FIG. 3 is a perspective view of a row assembly of the food holding cabinet of FIG. 1.

Referring to FIGS. 3 and 6, display face 134 comprises displays 144, 146 and 148 and buttons 150, 152 and 154. Displays 144, 146 and 148 display information concerning food items placed in corresponding locations on lower heating plate 114 of a corresponding row assembly. Buttons 150, 152 and 154 are manually operable to activate and deactivate timers that control food hold times. Buttons 150, 152 and 154 also play a role in manual programming.

Bezel 132 also comprises side legs 164. Each side leg 164 includes an open portion 166 and a notch 168. Bezel 132 also provides a duct 160 for cooling air to flow and cool a component, for example, components disposed on a display control board 162 (shown in FIG. 5) for displays 144, 146 and 148.

Bezels 132 and 133 are formed of a suitable material, for example, plastic or metal. Preferably, bezels 132 and 133 are composed of a plastic part and a molded in graphic overlay, which has a thermal conductivity lower than metal, although metallic bezels may be used in some embodiments. Buttons 150, 152 and 154 are attached to bezel 132 or 133 by any suitable fasteners, but are preferably heat staked in plastic bezels 132 and 133.

Figure 7:
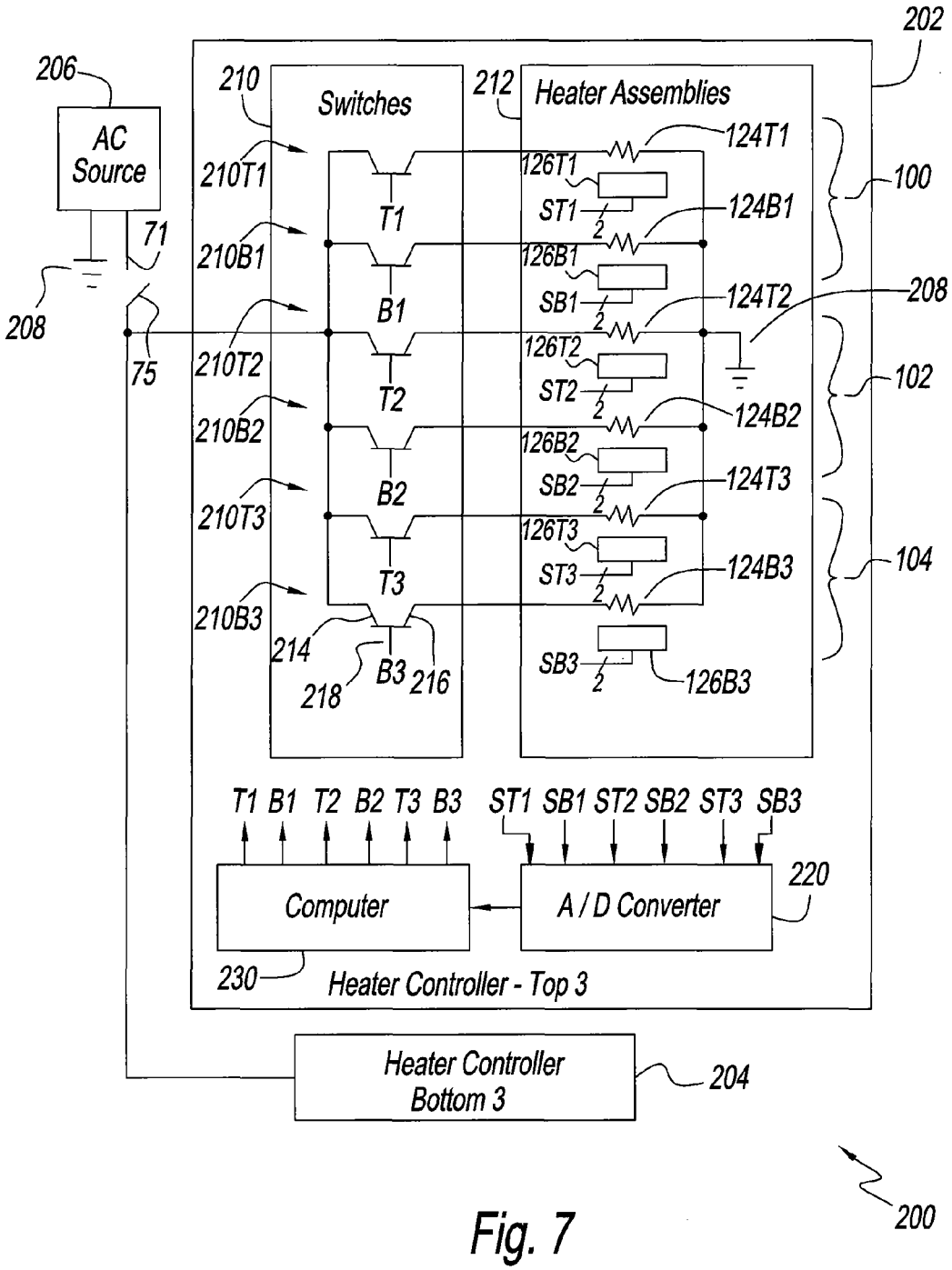
FIG. 7 is a schematic diagram of the heater controller of the food holding cabinet of FIG. 1.

Referring to FIGS. 1 and 7, an electrical cord 71 connects heater controller 202 to an outlet plug 73 that provides alternating current (AC) power from an AC source 206 via an ON/OFF switch 75 to a power module (not shown) that distributes operating power to various electrically operated components of food holding cabinet 70 that require AC power. The power module includes an AC to DC (direct current) converter (not shown) to provide DC power to those components that require DC operating power. Depending on the number of cabinet cavities, it is possible that the plurality of heater demands could exceed the branch circuit limitations to the cabinet (for example, at morning cabinet start up and other unusually high load times), thus tripping a circuit breaker, which, for example, is located in AC source 206. AC source 206 also includes connections to the AC power grid to receive a suitable AC power, for example, 220 volts. AC source 206 is also connected to a circuit reference, shown as circuit ground 208.

Referring to FIG. 7, upper heater controller 202 controls the application of AC power to the upper and lower heaters 124 of row assemblies 100, 102 and 104. Lower heater controller 204 controls the application of AC power to the upper and lower heaters 124 of row assemblies 106, 108 and 110. Upper heater controller 202 and lower controller 204 in all other respects are identical so that only upper heater controller 202 will be described in detail.

Upper heater controller 202 comprises a plurality of switches 210 and a plurality of heater assemblies 212. Heater assemblies 212 includes heaters 124 and temperature sensors 126 of row assemblies 100, 102 and 104. In FIG. 7, the upper heaters of row assemblies 100, 102 and 104 are denoted by reference characters 124T1, 124T2 and 124T3, respectively. The lower heaters of row assemblies 100, 102 and 104 are denoted by reference characters 124B1, 124B2 and 124B3, respectively. In FIG. 7, upper temperature sensors 126 of row assemblies 100, 102 and 104 are denoted as 126T1, 126T2 and 126T3, respectively. Lower temperature sensors 126 of row assemblies 100, 102 and 104 are denoted as 126B1, 126B2 and 126B3, respectively.

Switches 210 include switches 210T1, 210B1, 210T2, 210B2, 210T3 and 210B3 that are connected in circuit with heaters 124T1, 124B1, 124T2, 124B2, 124T3 and 124B3, respectively. Switches 210T1, 210B1, 210T2, 210B2, 210T3 and 210B3 may be any suitable switches that can handle the power used by cabinet 70. Preferably, switches 210 are thyristors that include three leads. For example, switch 210B3 comprises leads 214, 216 and 218. Lead 218 is a control lead that when activated by a signal B3 turns switch 210B3 on so that electrical current flows between leads 214 and 216. That is, with ON/OFF switch 75 in the ON position and thyristor 210B3 turned on by signal B3, AC source 206 is connected in circuit with heater 124B3. Similarly, signals T1, B1, T2, B2 and T3 turn on switches 210T1, 210B1, 210T2, 210B2 and 210T3, respectively, to connect respective heaters 124T1, 124B1, 124T2, 124B2 and 124T3 in circuit with AC source 206.

Temperature sensors 126T1, 126B1, 126T2, 126B2, 126T3 and 126B3 are connected in a circuit that provides currents ST1, SB1, ST2, SB2, ST3 and SB3 that vary with the temperature of respective heaters 124T1, 124B1, 124T2, 124B2, 124T3 and 124B3. This current flow is derived from the AC power supplied by AC source 206. For example, the current flow may suitably be DC current derived from an AC to DC converter (not shown).

The two leads of each temperature sensor 126T1, 126B1, 126T2, 126B2, 126T3 and 126B3 are also connected as inputs to an Analog to Digital (ND) converter 220. ND converter 220 provides output signals that are proportional to the current temperatures of the respective heaters 124T1, 124B1, 124T2, 124B2, 124T3 and 124B3 based on currents ST1, SB1, ST2, SB2, ST3 and SB3) to a computer 230. Computer 230 uses the current temperatures to determine an error or deviation from a set point temperature of each of the respective heaters 124T1, 124B1, 124T2, 124B2, 124T3 and 124B3. Computer 230, based on the errors, provides signals T1, B1, T2, B2, T3 and B3 to operate switches 210 to apply power as needed to restore the temperatures of the respective heaters 124T1, 124B1, 124T2, 124B2, 124T3 and 124B3 to the set point temperatures. That is, temperature sensors 126T1, 126B1, 126T2, 126B2, 126T3 and 126B3, A/D converter 220, computer 230 and switches 210T1, 210B1, 210T2, 210B2 and 210T3 are in a feedback loop to bring heaters 124T1, 124B1, 124T2, 124B2, 124T3 and 124B3 to the predetermined temperatures and to maintain them there as they drift due to heater off time, loading changes, voltage changes at AC source 206, and the like.

Figure 8:
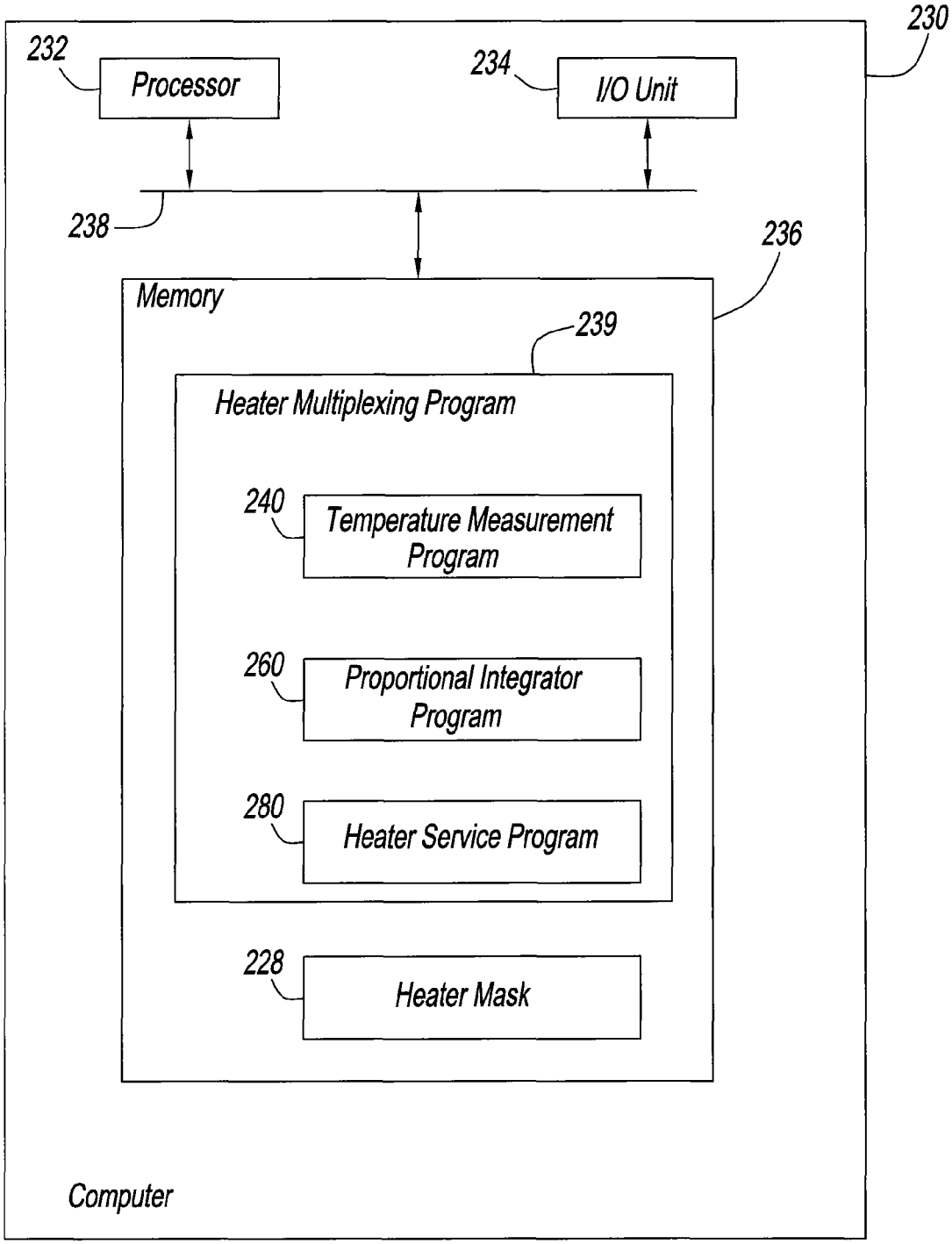
FIG. 8 is a block diagram of the computer of the heater controller of FIG. 7.

Referring to FIG. 8, computer 230 comprises a processor 232, an Input/Output (I/O) unit 234 and a memory 236 that are interconnected via a bus 238. Memory 236 comprises a heater time multiplexing program 239 that includes a temperature measurement program 240, a proportional integrator program 260 and a heat service program 280. Memory 236 also comprises a heater mask 228 that is used as a tool to time multiplex the heater. Memory 236 further comprises other programs (not shown), such as an operating system, utility programs, maintenance programs, and the like.

I/O unit 234 interfaces with input and output devices. For example, the outputs of ND converter 220 are inputs to I/O unit 234 and the output signals T1, B1, T2, B2, T3 and B3 are output signals that issue from I/O unit 234 to switches 210.

Processor 232 executes heater time multiplexing program 239. For example, processor 232 runs temperature measurement program 240 to provide temperature enable pulses at a temperature sampling rate or frequency via bus 238 and I/O unit 234 to A/D converter 220. A/D converter 220 responds to the temperature enable pulses to provide digital values that correspond to the current temperatures of heaters 124T1, 124B1, 124T2, 124B2, 124T3 and 124B3. These digital values are received by I/O unit 234 and supplied via bus 238 to processor 232 for use by temperature measurement program 240. Measurement program 240, when executed by processor 232 processes the digital measurement values to provide corresponding current temperature values for use by proportional integrator program 260. Proportional integrator program 260 calculates requested heater on times for the heaters based on the current digital temperature values. Heater service program 280 uses the calculated heater on times and heater mask 228 to time multiplex the AC power to the heaters.

Due to the multiplicity of loads (the 12 heaters of food holding cabinet 70), the likelihood is high that the power draw from AC source 206 will exceed the rating of a typical 220 volts branch circuit of the power grid and trip a breaker during high peak demands, such as during start up of food holding cabinet 70. As shown in FIG. 7, heater controller 200, which includes upper and lower heater controllers 202 and 204, respectively, avoids excessive load during these peak demand times by modulating or time multiplexing the on and off times of the individual heaters to supply AC power to each heater such that maximum power draw from the restaurant branch circuit is limited to rated levels or below at any time.

At the time of turning ON/OFF switch 75 on, processor 232 executes a program (not shown) that executes typical power up routines. When the power up routines have been completed, processor 232 begins execution of heater service program 280, temperature measurement program 240 and proportional integrator program 260.

Figure 9:
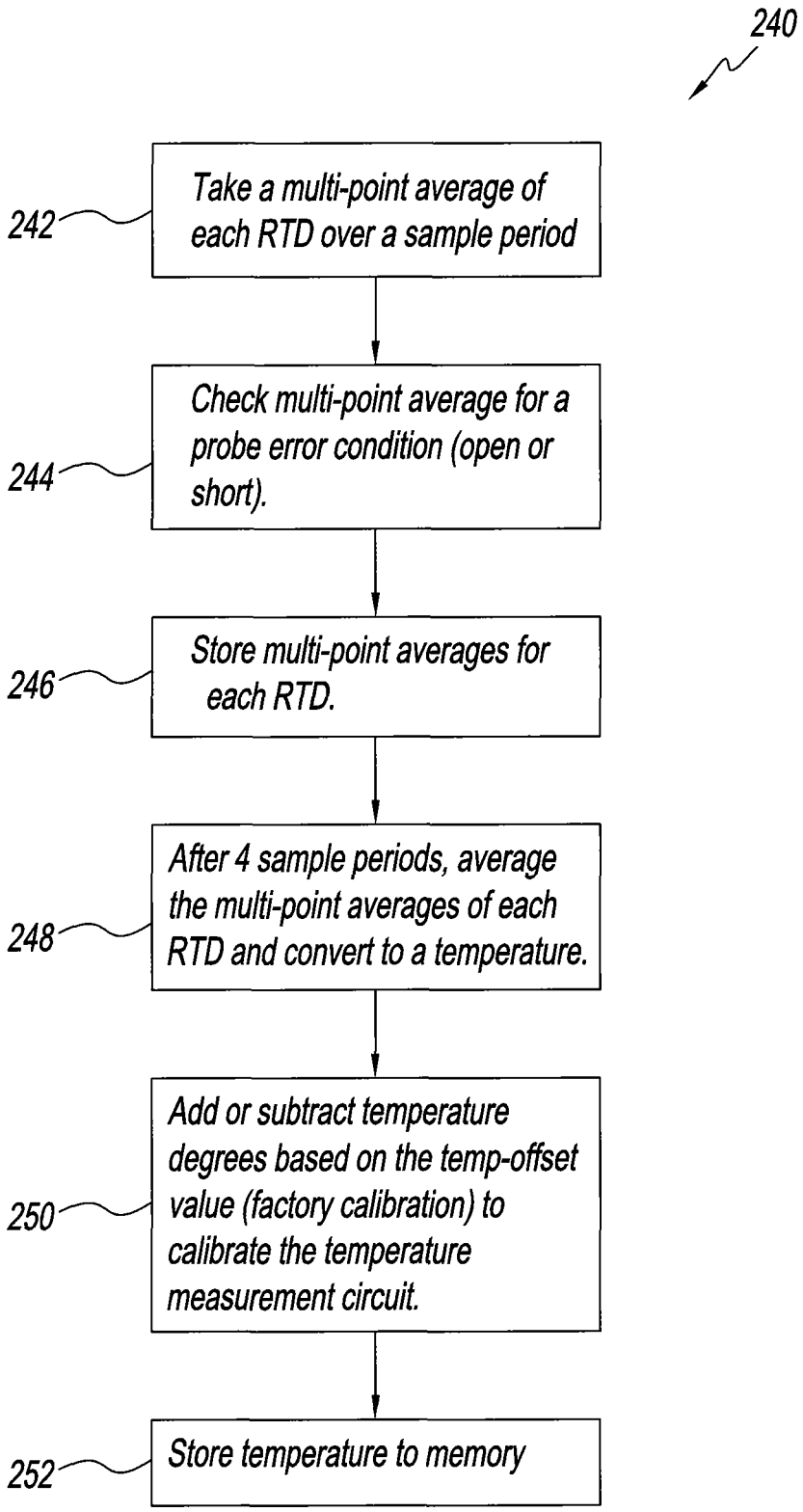
FIG. 9 is a flow diagram of the temperature measurement program of the computer of FIG. 8.

Referring to FIG. 9, temperature measurement program 240 at box 242 causes processor 232 to take a multi-point average of each RTD. That is, each RTD current is sampled at a plurality of time points to obtain a plurality of current values or temperature points during a sample period. The temperature points are averaged to yield an averaged multipoint value for each RTD. At box 244, the averaged multipoint values are checked for a probe error that may be open or a short, i.e., a failed probe. If a probe error is found, an error message is posted.

At box 246, the multipoint averaged RTD current values are stored. At box 248, after a plurality of sample periods (shown, e.g., as four) of the RTD multipoint averages of the sample periods are averaged and converted to temperature values. At box 250, the temperature values yielded by box 248 are modified based on addition or subtraction of temperature off set values (due to factory calibration of the RTDs) to calibrate the current temperature values. At box 252, the calibrated temperature values are stored to memory 236.

Figure 10:
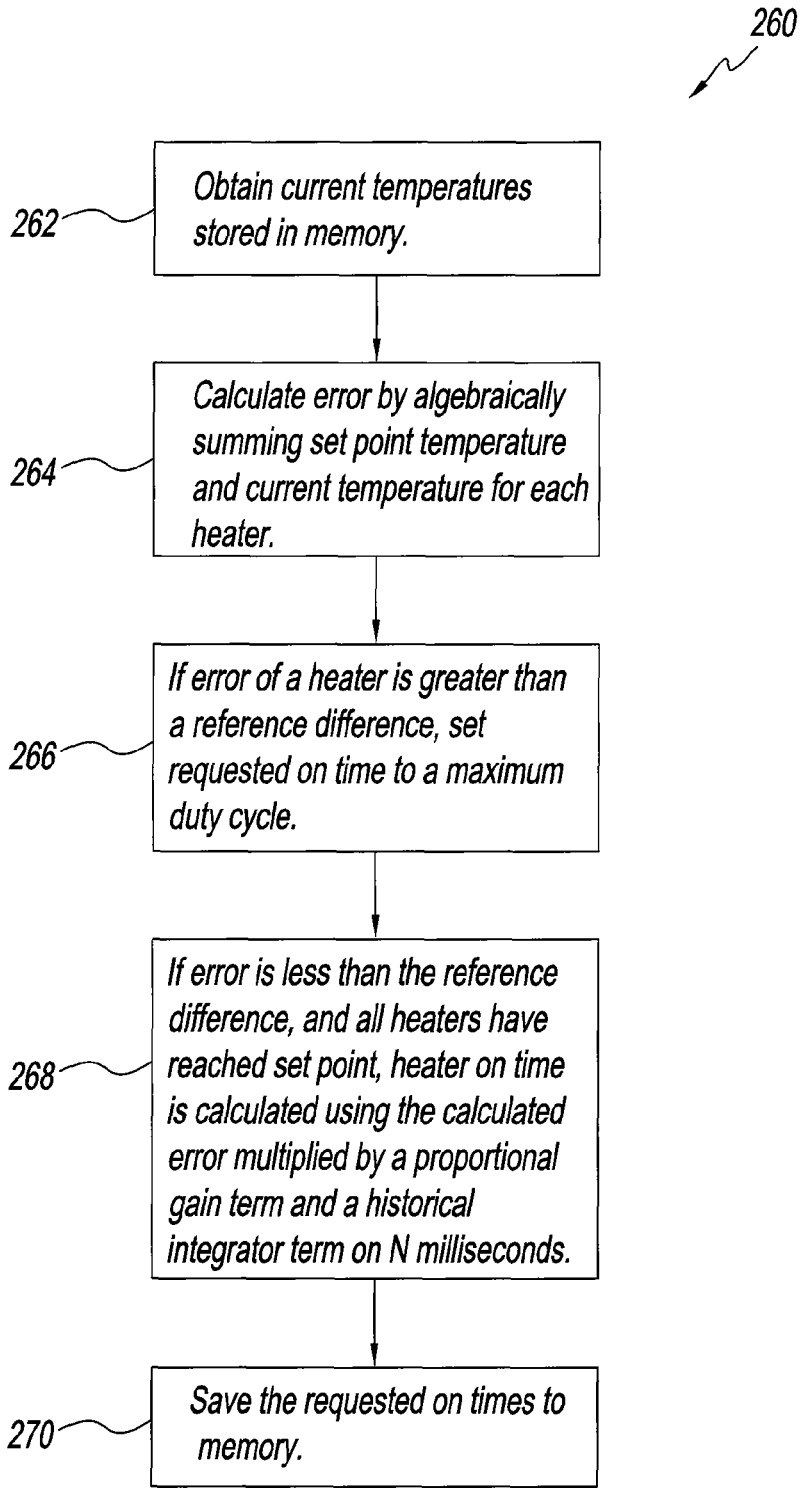
FIG. 10 is a flow diagram of the proportional integrator program of the computer of FIG. 8.

Referring to FIG. 10, proportional integrator program 260 at box 262 obtains the temperature values stored in memory 236 (see box 252 in FIG. 9). At box 264 the error for each heater is calculated by algebraically summing the set point temperature and the associated current temperature value. At box 266 if the error of a heater is greater than a reference difference, the requested heater on time is set based on a maximum duty cycle, which is a predetermined duty cycle M that is less than 100%. At box 268, if the error is less than the reference difference and all heaters have reached set point, the heater on time is calculated using the calculated error multiplied by a proportional gain term and a historical integrator term of N milliseconds. At box 270 the calculated heater on times are stored to memory 236.

Figure 11:
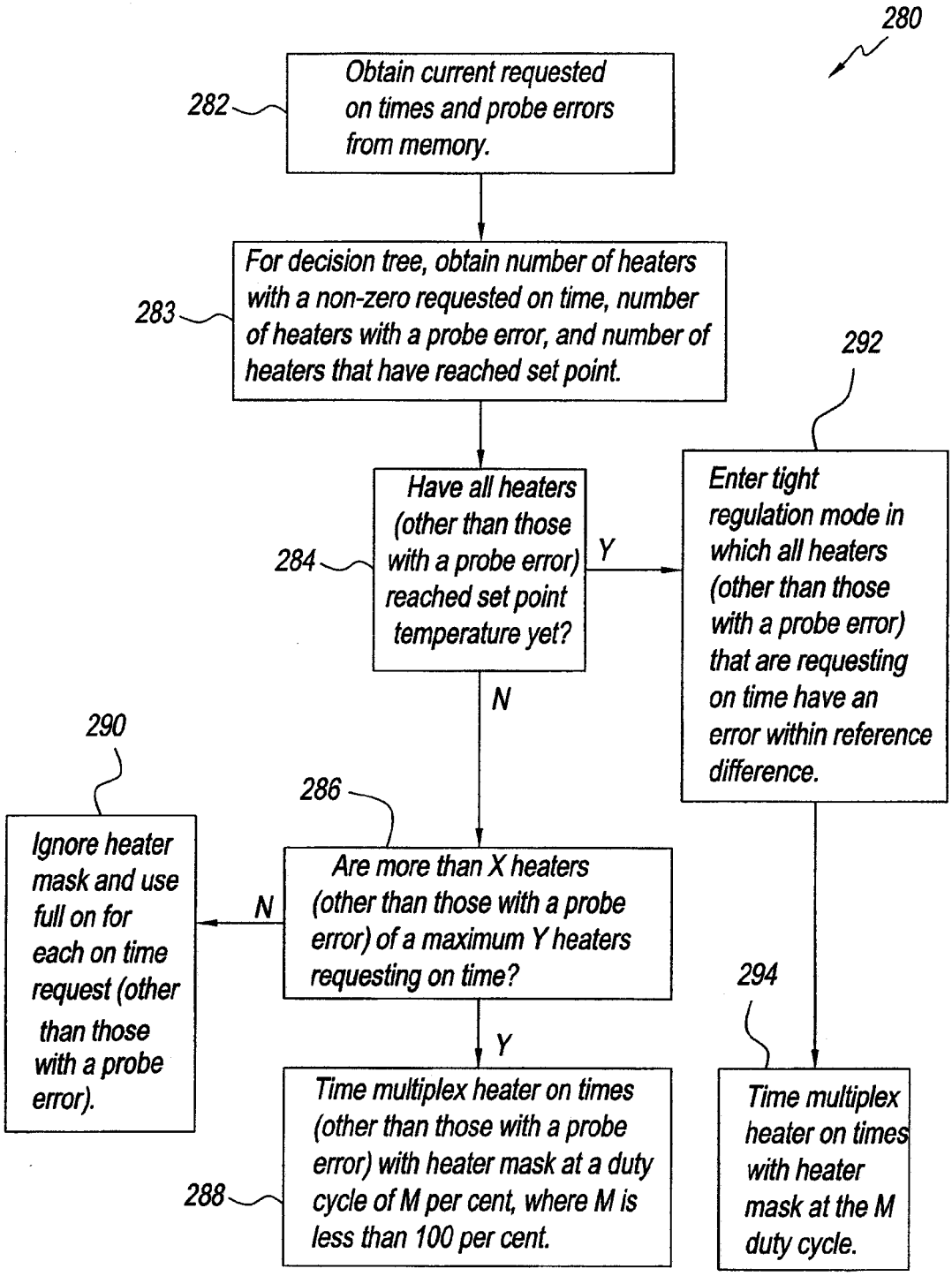
FIG. 11 is a flow diagram of the heater service program of the computer of FIG. 8.

Referring to FIG. 11, heater service program 280 at box 282 obtains the current requested on times and error probes (see box 270 of FIG. 10 and box 246 of FIG. 9). At box 283 heater service program 280 determines the number of heaters with a non-zero requested on time, the number of heaters with a probe error and the number of heaters that have reached set point temperature. At box 284, heater service program 280 determines whether all heaters (other than those with an probe error) have reached their respective set point temperatures. If not, heater service program 280 at box 286 determines if X or more heaters (other than those with a probe error) of a maximum or total of Y heaters have requested on time. If so, heater service program 280 at box 288 multiplexes the heater on times (other than those with a probe error) with heater mask 228 at the duty cycle M, which yields an on time pattern of the heaters in which X of the heaters are not all on at any one time. Due to the power rating of AC source 206, if more than X of the heaters are on at the same time, the breaker is likely to trip.

If the determination of box 286 is that less than X heaters have requested on time at box 290 heater service program 280 ignores heater mask 228 and uses full on for each on time request (other than those with a probe error). That is, each of the heaters is operated at a 100% duty cycle with no off time. If the determination of box 284 is that all the heaters (other than those with a probe error), have reached set point temperature, heater service program at box 292 enters a tight regulation mode in which all heaters that are requesting on time have an error within the reference difference. The heaters that are not requesting on time are turned off, i., e., their respective switch 210 is turned off.

The activities represented by boxes 284, 286, 288 and 290 constitute a loose regulation or high peak demand mode in which the on times of the heaters are time multiplexed so that only X of the total of Y heaters are on at the same time. For the illustrated embodiment, X=4 and Y=6 for each heater controller 202 and 204. The duty cycle M is two thirds or 66.67%. The period of each duty cycle for this embodiment is 300 milliseconds (ms), for which each heater is on for 200 ms and off for 100 ms. Temperature samples are taken every 200 microseconds (μs).

Heater mask 228 is a tool that is used by heater service program 280 to limit the heaters serviced by each heater controller 202 and 204 to four out of six heaters being on at any one time in either the tight regulation mode or the loose regulation mode, except when the heater mask is ignored as at box 290 (FIG. 11) in the loose regulation mode. Heater mask 228 comprises a bit position for each heater that it is used to control. If the bit value is "1", the associated heater is on. If the bit value is "0", the associated heater is off. The bit values are changed periodically to impart the 66.67% duty cycle for each heater. For the illustrated embodiment, this rate is once every 50 ms. At each change point, two of the bit values change. The Table below shows the bit values of heater mask 220 for six 50 ms intervals (i.e., one 300 ms period) for heaters 124T1, 124B1, 124T2, 124B2, 124T3 and 124B3.

TABLE

| 124T1 | 124B1 | 124T2 | 124B2 | 124T3 | 124B3 |
|---|---|---|---|---|---|
| 0 | 0 | 1 | 1 | 1 | 1 |
| 0 | 1 | 1 | 1 | 1 | 0 |
| 1 | 1 | 1 | 1 | 0 | 0 |

TABLE-continued

| 124T1 | 124B1 | 124T2 | 124B2 | 124T3 | 124B3 |
|---|---|---|---|---|---|
| 1 | 1 | 1 | 0 | 0 | 1 |
| 1 | 1 | 0 | 0 | 1 | 1 |
| 1 | 0 | 0 | 1 | 1 | 1 |

The bit values of the first row show that heaters 124T1 and 124B1 are off and heaters 124T2, 124B2, 124T3 and 124B3 are on for this 50 ms interval. To achieve this, computer 230 uses heat mask 228 to provide signals T1 and B1 to maintain switches 210T1 and 210B1 off so that no AC current is provided to heaters 124T1 and 124B1 and to provide signals T2, B2, T3 and B3 to maintain switches 210T2, 210B2, 210T3 and 210B3 on so that AC current flows through heaters 124T2, 124B2, 124T3 and 124B3. At the end of this 50 ms interval, processor 232 changes heat mask 228 to the bit pattern shown in the second row of the Table, which causes signals T1 and B3 to maintain switches 210T1 and 210B3 off so that no AC current is provided to heaters 124T1 and 124B3 and to provide signals B1, T2, B2 and T3 to maintain switches 210B1, 210T2, 210B2 and 210T3 on so that AC current flows through heaters 124B1, 124T2, 124B2 and 124T3. The processor continues to change heater mask 228 for each of the remaining rows and then starts another cycle with the first row and so on.

In the illustrated embodiment, step 242 of temperature measurement program 240 is repeated at a rate of four times a second with 8 sample points being taken each time for a total of 32 sample points per second.

The heater controller of the present disclosure controls power to the heating elements and unique power time multiplexing under peak demand to ensure total power remains well within the branch supply circuit limitations in these restaurants. In a similar fashion, heavy loads (such as an electric fryer) can utilize a similar method to reduce peak demand within a store.

It is contemplated that the heater controller described above can employ alternate time based methods (time base changes, sample periods, and so on). The basic restricting the absolute number of heaters on at the same time to limit power to the overall cabinet is disclosed in this disclosure. Other possible embodiments include but are not limited to:

1. Leaving four rows (8 heaters) on full until set point to allow the customer to begin holding food in those positions earlier. The remaining four heaters would get some heating from convection and conduction generated by powered plates to give them a head start. The remaining two rows (4 heaters) would immediately follow without allowing the first eight to fall too far out of set point.
2. Since most of the energy for holding comes from the bottom plate, all six bottom plates in addition to two upper plates could be powered. The remaining four heaters would come on once the first eight reached their set point.
3. In combination with #1, staggering rows to be heated to set point would allow other rows in between to attain some energy from convection and conduction through the cabinet.
4. Wattage could be adjusted on the heater plates to allow more or less heaters to be on at any given time.

The present invention having been thus described with particular reference to the preferred forms thereof, it will be obvious that various changes and modifications may be made therein without departing from the spirit and scope of the present invention as defined in the appended claims.

What is claimed is:

1. A control system that controls current flow in a plurality of loads of a food service system comprising:

a like plurality of switches; and a controller that operates said switches to connect said plurality of loads to a power source during a high demand time such that the total power consumption of said loads is limited to a rated power level or below of said power source for at least a portion of said high demand time.

2. The control system of claim 1, wherein said controller controls on times of said switches at a duty cycle in which only X of the total number of said switches are turned on at the same time, where X is greater than two and wherein said duty cycle is less than 100 percent.

3. The control system of claim 2, wherein said total number of switches is twelve, X is eight, and said duty cycle is 66.67%.

4. The control system of claim 2, wherein said switches and said loads are connected in a feedback system, and wherein said on times are determined by feedback of at least one parameter of said loads.

5. The control system of claim 4, wherein said on times are based on a difference between a current value of said parameter and a reference value of said parameter.

6. The control system of claim 5, wherein said parameter is a temperature.

7. The control system of claim 2, wherein said food service system is a food holding cabinet and said loads are heaters.

8. The control system of claim 7, wherein said controller further comprises a processor that executes a heater multiplexing program and uses a heater mask to provide signals that operate said switches.

9. The control system of claim 8, wherein if less than X heaters are requesting on time, said processor ignores said heater mask and operates said switches such that said duty cycle for each of said heaters is 100%.

10. The control system of claim 8, wherein if said difference is within a range of a predetermined temperature and said reference temperature, said controller enters a tight regulation mode in which said switches are operated at said duty cycle of less than 100%.

11. A method of controlling current flow in a plurality of loads in a food service system, said method comprising:

controlling a like plurality of switches to connect said plurality of loads to a power source during a high demand time such that the total power consumption of said loads is limited to a rated power level or below of said power source for at least a portion of said high demand time.

12. The method of claim 11, wherein said controlling step controls on times of said switches at a duty cycle in which only X of the total number of said switches are turned on at the same time, where X is greater than two and wherein said duty cycle is less than 100 percent.

13. The method of claim 12, wherein said total number of switches is twelve, X is eight, and said duty cycle is 66.67%.

14. The method of claim 12, wherein said switches and said loads are connected in a feedback system, and wherein said on times are determined by feedback of at least one parameter of said loads.

15. The method of claim 14, wherein said on times are based on a difference between a current value of said parameter and a reference value of said parameter.

16. The method of claim 15, wherein said parameter is a temperature.

17. The method of claim 12, wherein said food service system is a food holding cabinet and said loads are heaters.

18. The method of claim 17, wherein said controlling step comprises a processor that executes a heater multiplexing program and uses a heater mask to provide signals that operate said switches.

19. The method of claim 18, wherein if less than X heaters are requesting on time, said processor ignores said heater mask and operates said switches such that said duty cycle for each of said heaters is 100%.

20. The method of claim 18, wherein if said difference is within a range of a predetermined temperature and said reference temperature, said controller enters a tight regulation mode in which said switches are operated at said duty cycle of less than 100%.

* * * * *